US010246298B2

(12) United States Patent
Piech et al.

(10) Patent No.: US 10,246,298 B2
(45) Date of Patent: Apr. 2, 2019

(54) ROPELESS ELEVATOR SYSTEM

(71) Applicant: Otis Elevator Company, Farmington, CT (US)

(72) Inventors: Zbigniew Piech, Cheshire, CT (US); Tadeusz Witczak, Lodz (PL)

(73) Assignee: OTIS ELEVATOR COMPANY, Farmington, CT (US)

( * ) Notice: Subject to any disclaimer, the term of this patent is extended or adjusted under 35 U.S.C. 154(b) by 196 days.

(21) Appl. No.: 15/100,712

(22) PCT Filed: Dec. 5, 2013

(86) PCT No.: PCT/US2013/073297
§ 371 (c)(1),
(2) Date: Jun. 1, 2016

(87) PCT Pub. No.: WO2015/084364
PCT Pub. Date: Jun. 11, 2015

(65) Prior Publication Data

US 2016/0297646 A1 Oct. 13, 2016

(51) Int. Cl.
*B66B 11/04* (2006.01)
*B66B 7/02* (2006.01)
*B66B 9/00* (2006.01)

(52) U.S. Cl.
CPC ..... *B66B 9/003* (2013.01); *B66B 7/021* (2013.01); *B66B 11/04* (2013.01)

(58) Field of Classification Search
CPC ..... B66B 9/003; B66B 7/021; B66B 13/30
See application file for complete search history.

(56) References Cited

U.S. PATENT DOCUMENTS 5,566,784 A 10/1996 Rennetaud
2003/0217893 A1* 11/2003 Dunser ..... B66B 1/2466 187/249

(Continued)

FOREIGN PATENT DOCUMENTS

JP H05286669 A 11/1993
JP 05338946 A * 12/1993

(Continued)

OTHER PUBLICATIONS

English Machine Translation of JPH06048672.*

(Continued)

*Primary Examiner* — Diem M Tran
(74) *Attorney, Agent, or Firm* — Cantor Colburn LLP

(57) ABSTRACT

An elevator system (10) is disclosed. The elevator system (10) may comprise a hoistway (18) including first and second hoistway portions (12, 16), a first car (14), a first stationary stator (44*a*) disposed in the first hoistway portion (12) and a second stationary stator (44*b*) disposed in the second hoistway portion (16), a first mover (42) mounted on the first car (14), and a first guiderail (62) disposed in the first hoistway (12). The first hoistway portion (12) may be free of other guiderails (62) for the first car (14). The first car (14) may be propelled in the first hoistway portion (12) by only the interaction of the first mover (42) with the first stationary stator (44*a*). The first car (14) may be propelled in the second hoistway portion (16) by only the interaction of the first mover (42) with the second stationary stator (44*b*).

16 Claims, 13 Drawing Sheets

(56) References Cited

U.S. PATENT DOCUMENTS

| | | | | |
|---|---|---|---|---|
| 2007/0181374 | A1 | 8/2007 | Mueller | |
| 2013/0206514 | A1* | 8/2013 | Kim | B66B 9/025 187/240 |
| 2016/0046464 | A1* | 2/2016 | Piech | B66B 9/003 187/249 |

FOREIGN PATENT DOCUMENTS

| | | | | | |
|---|---|---|---|---|---|
| JP | 06048672 | A | * | 2/1994 | |
| JP | 06340390 | A | * | 12/1994 | |
| JP | H0781863 | A | | 3/1995 | |
| JP | H07157239 | A | | 6/1995 | |
| JP | H07043105 | Y2 | | 10/1995 | |
| JP | 2791203 | B2 | | 8/1998 | |
| WO | 2011140887 | A1 | | 11/2011 | |
| WO | 2012038760 | A2 | | 3/2012 | |
| WO | WO-2016206757 | A1 | * | 12/2016 | B66B 7/044 |

OTHER PUBLICATIONS

International Search Report and Written Opinion for application PCT/US2013/073297, dated Sep. 1, 2014, 13 pages.
European Search Report for application EP 13898800.1, dated Oct. 30, 2017, 10 pages.

* cited by examiner

ROPELESS ELEVATOR SYSTEM

FIELD OF THE DISCLOSURE

The present disclosure generally relates to elevator systems, and, in particular, relates to self-propelled elevator systems.

BACKGROUND OF THE DISCLOSURE

Self-propelled elevator systems, also referred to as ropeless elevator systems, are envisioned as useful in various applications (i.e., high rise buildings) where there is a desire for multiple elevator cars in a single hoistway portion.

These self-propelled elevator systems may utilize cylindrical-shaped elevator hoistways that are expensive to build, and multiple motors disposed on different sides of the elevator car in conjunction with multiple guide rails and supports. The use of multiple motors on an elevator car adds additional weight that must be carried by the car, takes up space in the hoistway and increases system cost. Similarly, the use of multiple guide rails and supports takes up additional space in the hoistway and increases the overall foot print of the hoistway. A better design is desired.

SUMMARY OF THE DISCLOSURE

In accordance with one aspect of the disclosure, an elevator system is disclosed. The elevator system may comprise a hoistway including a first hoistway portion and a second hoistway portion, a first car disposed within the first hoistway portion, a first stationary stator disposed in the first hoistway portion, a second stationary stator disposed in the second hoistway portion, a first mover mounted on the first car, and a first guiderail disposed in the first hoistway portion. The first car is propelled in the first hoistway portion by only the interaction of the first mover with the first stationary stator, and the first car is propelled in the second hoistway portion by only the interaction of the first mover with the second stationary stator. In an embodiment, the first hoistway portion is free of other guiderails.

In a refinement, the first car has a first side, and a second side opposite to the first side. The first mover is adjacent to the first side and the first guiderail is disposed adjacent to the second side of the first car when the first car is disposed in the first hoistway portion.

In another refinement, the first car may include a first car inner vertical corner. The first mover may be mounted on the first car inner vertical corner. In a further refinement, the first guiderail may be disposed diagonally opposite to the first mover when the first car is disposed in the first hoistway portion.

In another refinement, the elevator system may further include a second car disposed within the second hoistway portion, and a second mover mounted on the second car. The second car may be propelled in the second hoistway portion by only the interaction of the second mover with the second stationary stator and the second car propelled in the first hoistway portion by only the interaction of the second mover with the first stationary stator. In a further refinement, the second car may include a second car inner vertical corner on which the second mover is mounted. In yet a further refinement, the elevator system may further include a second guiderail disposed in the second hoistway portion. In such further refinement, the second hoistway portion may be free of other guiderails.

In accordance with another aspect of the disclosure, another elevator system is disclosed. The elevator system may comprise a hoistway including a first hoistway portion and a second hoistway portion, a first guiderail disposed in the first hoistway portion, a second guiderail disposed in the second hoistway portion, a first stationary stator disposed in the first hoistway portion opposite to the first guiderail, a second stationary stator disposed in the second hoistway portion opposite to the second guiderail, and a plurality of elevator cars. Each car may have a mover mounted to the car and a guide portion mounted to the car. The guide portion may be disposed opposite to the mover. The first hoistway portion is free of other guiderails and the second hoistway portion is free of other guiderails. In the embodiment, the mover interacts with only the first stationary stator and the guide portion interacts with only the first guiderail, when the car is in the first hoistway portion, and the mover interacts only with the second stationary stator and the guide portion interacts with only the second guiderail, when the car is in the second hoistway portion.

In a refinement, each car may include an inner vertical corner on which the mover is mounted. In a further refinement, the first guiderail may be diagonally opposite to the mover when the car is in the first hoistway portion, and the second guiderail may be diagonally opposite to the mover when the car is in the second hoistway portion.

In another refinement, the elevator system may further comprise a support column generally vertically disposed between the first and second hoistway portions. The first and second stationary stators may be mounted on the support column.

In accordance with yet another aspect of the disclosure, another elevator system is disclosed. The elevator system may comprise a hoistway including a first hoistway portion and a second hoistway portion, a car disposed within the first hoistway portion, a first mover mounted on the car, a first stationary stator disposed in the first hoistway portion and a second stationary stator disposed in the second hoistway portion. The car is operably moveable from the first hoistway portion to the second hoistway portion. The car has a plurality of sides. In an embodiment, all of the sides of the car may be non-curvilinear. The first mover interacts with the first stationary stator to propel the car when the car is in the first hoistway portion, and the first mover interacts with the second stationary stator to propel the car when the car is in the second hoistway portion.

In a refinement, the car may be rotatable about an axis of rotation from the first hoistway portion to the second hoistway portion. In a further refinement, the axis of rotation may be a vertical axis. In an alternative refinement, the axis of rotation may be a horizontal axis.

In another refinement, the first stationary stator remains in the first hoistway portion when the car has been operably moved to the second hoistway portion.

In another refinement, the elevator system may further include a first guiderail disposed generally vertically in the first hoistway portion, and a first guide portion mounted on the car. The first guide portion interacts with the first guiderail when the car is disposed in the first hoistway portion.

In another refinement, the elevator system may further include a transfer stator disposed in the hoistway. The transfer stator may be rotatable with the car about an axis of rotation from the first hoistway portion to the second hoistway portion. In a further refinement, the axis of rotation is an axis of symmetry with respect to the first mover position relative to the car.

In another refinement, the elevator system may further include a second mover mounted on the car, a third stationary stator disposed in the first hoistway portion, and a fourth stationary stator disposed in the second hoistway portion. The second mover may interact with the third stationary stator to propel the car when the car is in the first hoistway portion, and the second mover may interact with the fourth stationary stator to propel the car when the car is in the second hoistway portion.

These and other aspects of this disclosure will become more readily apparent upon reading the following detailed description when taken in conjunction with the accompanying drawings.

Figure 1:
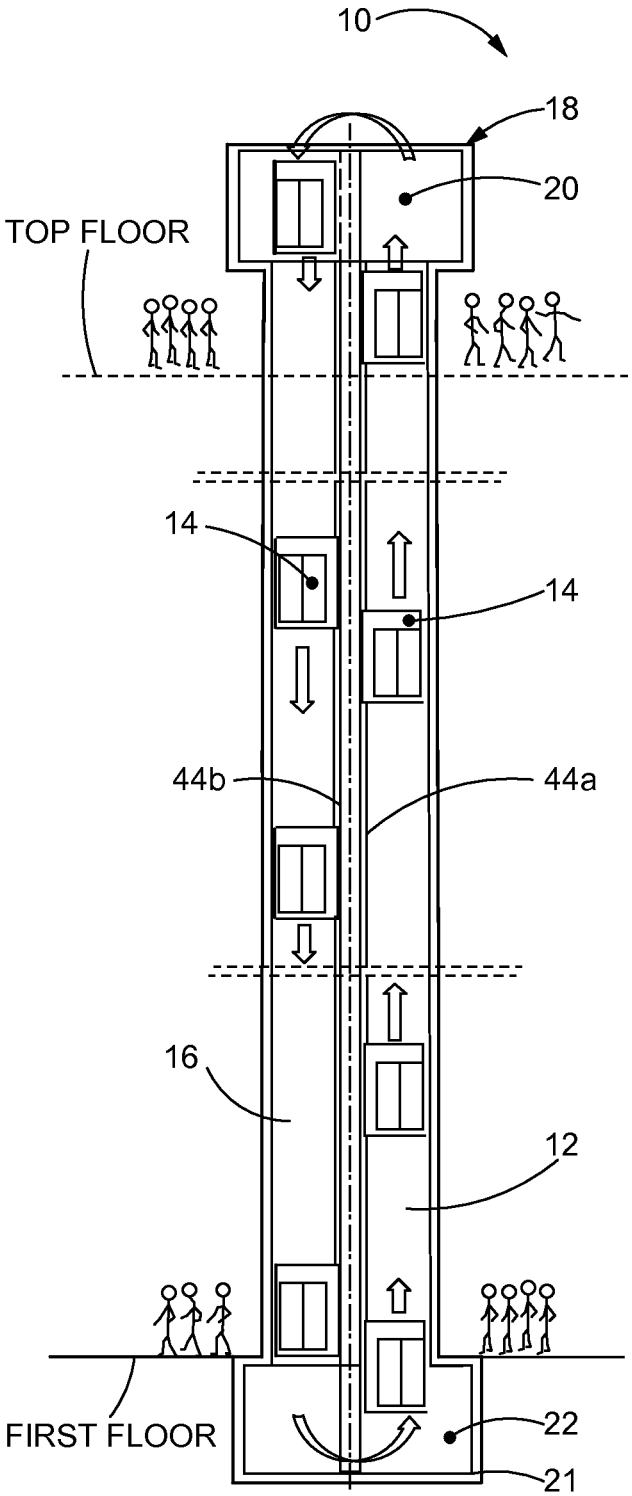
FIG. 1 is an embodiment of an exemplary elevator system.

While the present disclosure is susceptible to various modifications and alternative constructions, certain illustrative embodiments thereof have been shown in the drawings and will be described below in detail. It should be understood, however, that there is no intention to be limited to the specific forms disclosed, but on the contrary, the intention is to cover all modifications, alternative constructions, and equivalents falling within the spirit and scope of the present disclosure.

DETAILED DESCRIPTION OF THE DISCLOSURE

Referring now to FIG. 1, an elevator system 10 is shown in schematic fashion. It is to be understood that the exemplary version of the elevator system 10 shown in FIG. 1 is for illustrative purposes only and to present background for the various components of a general elevator system.

As shown in FIG. 1, the elevator system 10 comprises a hoistway 18 that includes a first hoistway portion 12 and a second hoistway portion 16. The first and second hoistway portions 12, 16 may each be disposed vertically within a multi-story building. The first and second hoistway portions 12, 16 may be dedicated to directional travel. In some embodiments, the first and second hoistway portions 12, 16 may be part of a single open hoistway 18. In other embodiments, the first and second hoistway portions 12, 16 may be part of a divided hoistway 18 that has a wall or other divider between the first and second hoistway portions 12, 16. The hoistway 18 is not limited to two hoistway portions. In some embodiments, the hoistway 18 may include more than two hoistway portions disposed vertically within a multi-story building.

In the embodiment illustrated in FIG. 1, elevator cars 14 may travel upward in the first hoistway portion 12. Elevator cars 14 may travel downward in the second hoistway portion 16. Elevator system 10 transports elevator cars 14 from a first floor to a top floor in the first hoistway portion 12 and transports elevator cars 14 from the top floor to the first floor in the second hoistway portion 16. Above the top floor is an upper transfer station 20 where elevator cars 14 from the first hoistway portion 12 are moved to the second hoistway portion 16 as described in further detail herein. It is understood that the upper transfer station 20 may be located at the top floor, rather than above the top floor. Below the first floor is a lower transfer station 22 where elevator cars 14 from the second hoistway portion 16 are moved to the first hoistway portion 12. It is understood that lower transfer station 22 may be located at the first floor, rather than below the first floor. Although not shown in FIG. 1, elevator cars 14 may stop at intermediate floors to allow ingress to and egress from an elevator car 14.

Figure 2:
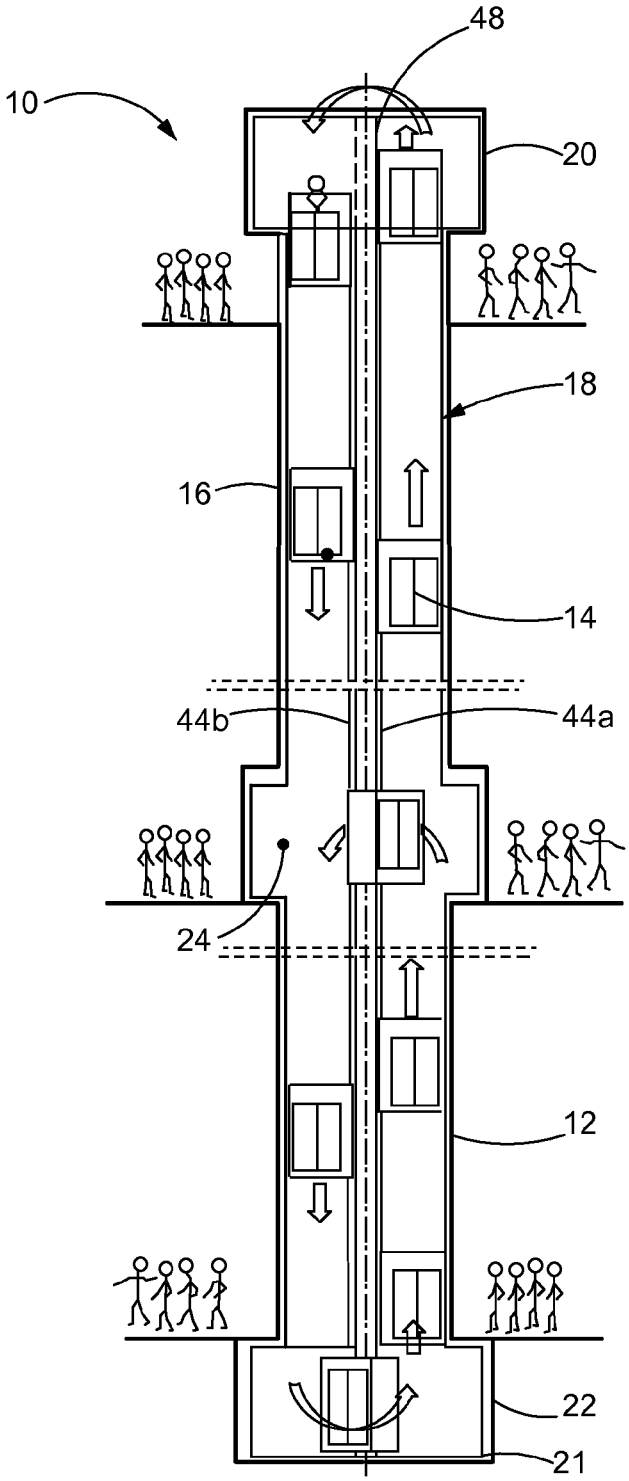
FIG. 2 is an another embodiment of an exemplary elevator system.

FIG. 2 depicts another exemplary embodiment of the elevator system 10. In this embodiment, the elevator system 10 includes an intermediate transfer station 24 located between the first floor and the top floor where the elevator car 14 may be moved from the first hoistway portion 12 to the second hoistway portion 16 and vice versa. Although a single intermediate transfer station 24 is shown, it is understood that more than one intermediate transfer station 24 may be used. Such an intermediate transfer may be utilized to accommodate elevator calls. For example, one or more passengers may be waiting for a downward traveling car 14 at a landing on a floor. If no cars 14 are available, an elevator car 14 may be moved from the first hoistway portion 12 to the second hoistway portion 16 at intermediate transfer station 24 and then moved to the appropriate floor to allow the passenger(s) to board. It is noted that elevator cars may be empty prior to transferring from one hoistway portion to another at any of the upper transfer station 20, lower transfer station 22, or intermediate transfer station 24.

FIGS. 3A-11 illustrate the operable moving of an elevator car 14 from a first hoistway portion 12 to a second hoistway portion 16 at a transfer station. The term "operable moving" or "operably moveable" means that the movement is automatic as part of the utilization of or testing of the elevator system and is not manual.

Figure 3A:
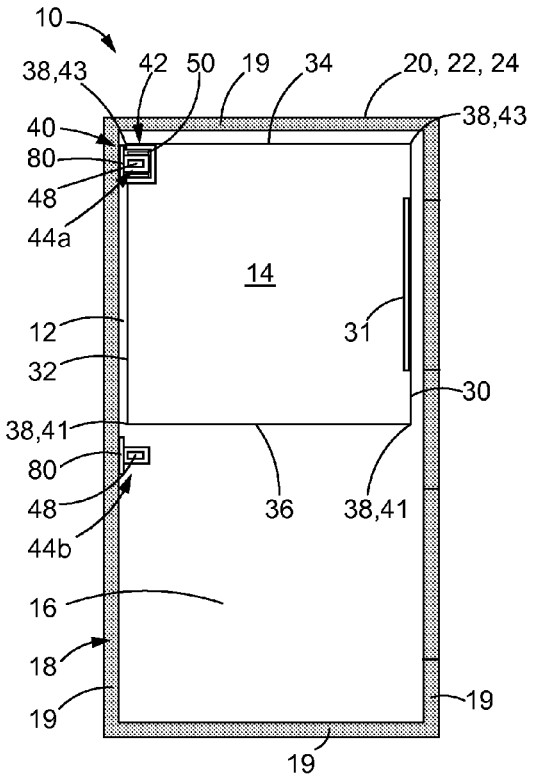
FIG. 3A is a top view of one embodiment of an elevator car in a first hoistway portion.

FIGS. 3A-F show shifting of the car 14 at the transfer station from the first hoistway portion 12 to the second hoistway portion 16 in a direction parallel to the floor of the hoistway 18 ("horizontal shifting"). In FIG. 3A, therein is illustrated a top view of an elevator system 10 comprising a hoistway 18 and a car 14. The hoistway 18 includes a first hoistway portion 12 and a second hoistway portion 16. The region between the first and second hoistway portions may be referred to as the transition region 39. The elevator hoistway 18 has a plurality of sidewalls 19 extending in a generally vertical direction from a generally horizontal floor 21 (FIGS. 1-2). The car 14 (FIG. 3A) includes a front side 30 in which a door 31 is disposed, a back side 32 opposite to the front side 30, a left side 34, a right side 36, a top (not shown) and a bottom (not shown). Right and left sides 36, 34 of the car 14 are determined from the perspective of a person inside the car 14 and facing the door 31. Each car 14 has vertical corners 38 that are the intersection of two sides (walls) of the car 14, for example, the back side 32 and the right side 36 of the car 14. Vertical corners 38 that are disposed adjacent to the transition region 39 may be referred to as inner vertical corners 41. Vertical corners 38 of the car 14 that are not in the transition region 39 and are disposed adjacent to one or more of the sidewalls 19 of the hoistway 18 may be referred to as outer vertical corners 43.

The elevator system 10 further includes a mover 42 and a stationary stator 44. At least one mover 42 is mounted on each car 14 disposed in each hoistway. In one embodiment, the mover 42 may include a plurality of magnets 50 (for example, permanent magnets, electromagnets). The stationary stator 44 may be mounted on a support column 80 or on a sidewall 19 of the hoistway 18. In the exemplary elevator system 10, a stationary stator 44 is mounted generally vertically in each hoistway portion 12, 16. The stationary stator 44 may include a plurality of coils of wire 48 operably connected to a source of electricity (not shown).

Figure 3B:
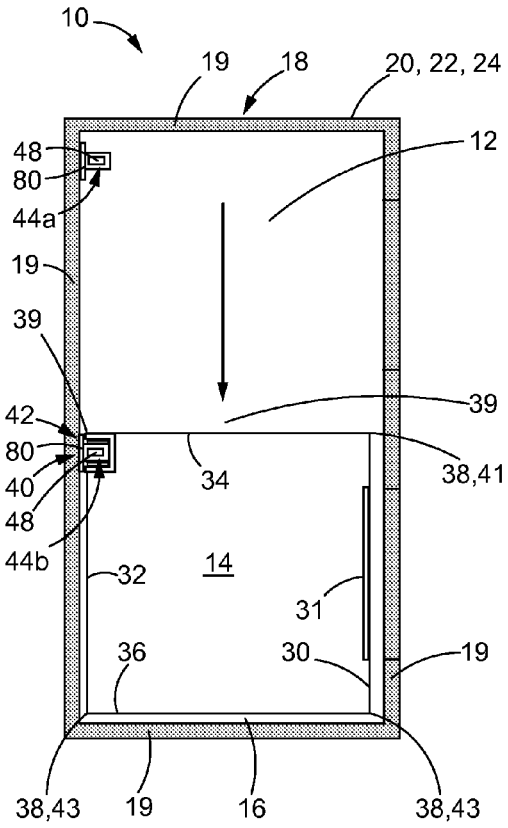
FIG. 3B is a top view of the elevator car of FIG. 3A after it has been shifted into the second hoistway portion.
Figure 3C:
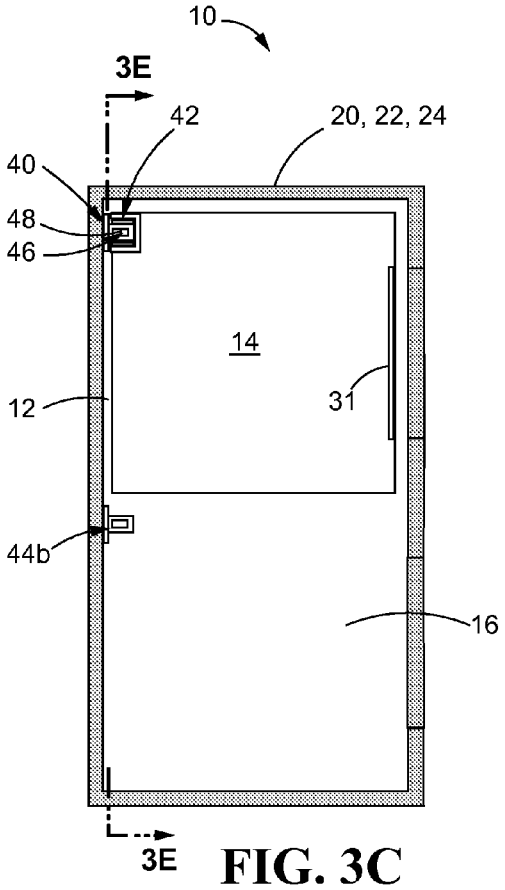
FIG. 3C is a top view of one embodiment of an elevator car in a first hoistway portion.
Figure 3D:
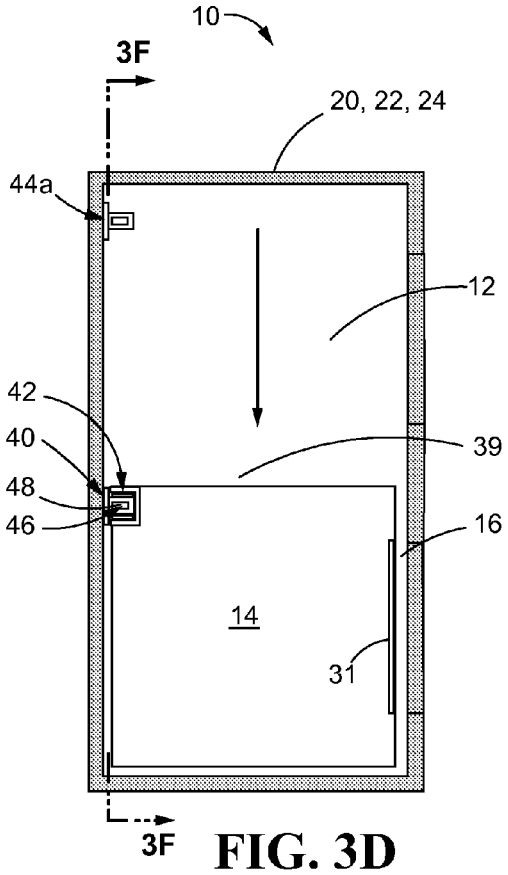
FIG. 3D is a top view of the elevator car of FIG. 3C after it has been shifted into the second hoistway portion.

In some embodiments, the elevator system 10 may further include a transfer stator 46 (FIGS. 3C-D). Similar to the stationary stator 44, the transfer stator 46 may also include a plurality of coils of wire 48 operably connected to the source of electricity (not shown). The transfer stator 46 may be moveable from a first position in the first hoistway portion 12 to a second position in the second hoistway portion 16.

In operation, the interaction of the mover 42 and the stator 44, 46 generates a thrust that propels the car 14 (attached to the mover 42). For example, in one embodiment, the mover 42 (and the car 14 attached to the mover 42) is propelled vertically when the coils of wire 48 of the stator (44 or 46) adjacent to the mover 42 are energized.

In FIG. 3A a car 14 is disposed in the first hoistway portion 12. In this exemplary embodiment, the mover 42 is disposed proximal to the back side 32 of the car 14 near a vertical corner 38. While in the first hoistway portion 12, the interaction of the mover 42 and the stationary stator **44*a* propels the car 14**.

In FIG. 3B, the car 14 is disposed in the second hoistway portion 16. The arrow in FIG. 3B illustrates the horizontal shifting of the car 14 from the first hoistway portion 12 into the second hoistway portion 16. When disposed in the second hoistway portion 16, the mover 42 is disposed near the transition region 39 between the first and second hoistway portions 12, 16 by virtue of the horizontal shift of the car 14 from the first hoistway portion 12 to the second hoistway portion 16. While in the second hoistway portion 16, the interaction of the mover 42 and the stationary stator **44*b* propels the car 14**.

In embodiments where the elevator system 10 does not include the transfer stator 46, the mover 42 moves with the car 14 but the first stationary stator **44*a* may not. Thus, once the car 14 has moved from the first hoistway portion 12 to the second hoistway portion 16, the mover 42 may be adjacent to a stationary stator 44*b* other than the first stationary stator 44*a*. This scenario is illustrated in FIGS. 3A-B. In FIG. 3A, the waiting stationary stator 44*b* at the transfer station can be seen in the second hoistway portion 16. In FIG. 3B, the first stationary stator 44*a* (at the transfer station), relieved of its operable connection to the mover 42, may be seen in the first hoistway portion 12**.

Figure 3E:
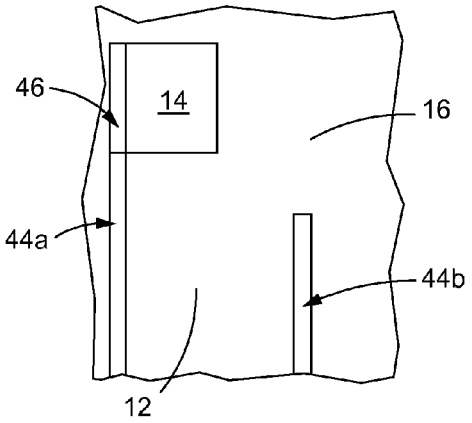
FIG. 3E is a schematic side view of the hoistway and elevator car of FIG. 3C taken along the lines of 3E-3E.
Figure 3F:
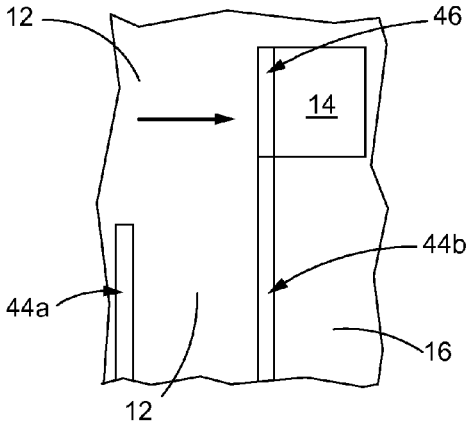
FIG. 3F is a schematic side view of the hoistway and elevator car of FIG. 3D taken along the lines of 3F-3F.

This scenario can be contrasted with the embodiment illustrated in FIGS. 3C-F in which the elevator system 10 includes a mover 42, a stationary stator 44 (**44*a*, 44*b*: best seen in FIGS. 3E-3F) and a transfer stator 46. In the scenario illustrated in FIGS. 3C-3F, both the transfer stator 46 and the mover 42 shift with the car 14 from the first hoistway portion 12 into the second hoistway portion 16. As best shown in FIG. 3E, the first stationary stator 44*a* is mounted in the first hoistway portion 12 and the transfer stator 46 (FIGS. 3C and 3E) is positioned in the first hoistway portion 12 at the transfer station (and adjacent to the stationary stator 44*a*). Both the transfer stator 46 and the mover 42 shift horizontally with the car 14 from the first hoistway portion 12 to the second hoistway portion 16. Initially after the shift, the mover 42 is adjacent to the transfer stator 46 (FIG. 3F). However, as the car 14 travels vertically the mover 42 will transition from the transfer stator 46 to the stationary stator 44*b* mounted in the second hoistway portion 16**.

In the embodiments illustrated in FIGS. 3A-D, one linear motor 40 per car is illustrated. The linear motor 40 is comprised of the mover 42 mounted to the car 14 and the stator (**44*a*, 44*b* or 46) with which the mover 42 interacts to cause the motion of the car 14. Other embodiments may include more than one linear motor per car 14. In addition, in some embodiments, the elevator system 10 may also include one or more car guidance systems 60 (see, for example, FIG. 6**).

FIGS. 4-7 illustrate the rotation of the car 14 about an axis Y from the first hoistway portion 12 to the second hoistway portion 16 in the transfer station. The axis Y is perpendicular to the floor 21 (FIGS. 1-2) of the hoistway 18 (the "vertical axis"). In some embodiments, a side of the car 14 (FIGS. 4-7) is substantially centered on the vertical axis. In some embodiments, the side of the car centered on the vertical axis is linear and not curved ("non-curvilinear"). In other embodiments, the car may have one or more non-curvilinear sides, a top and a bottom.

Figure 4A:
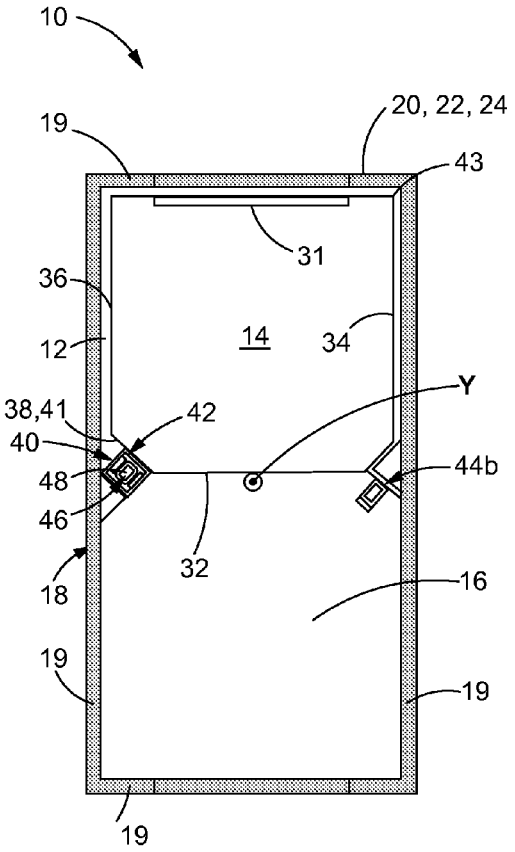
FIG. 4A is a top view of one embodiment of an elevator car in a first hoistway portion.

In FIG. 4A, therein is an embodiment of the elevator system 10 that includes the hoistway 18, the car 14, a mover 42 and stationary stators 44*a*, 44*b* (best seen in FIGS. 1-2). The hoistway 18 (FIG. 4A) includes a first hoistway portion 12, and a second hoistway portion 16. The mover 42 is mounted on the car 14. The stationary stators 44*a*, 44*b* may each be mounted on a support column (not pictured) or sidewall 19 of the hoistway 18. The elevator system 10 may further include the transfer stator 46. Similar to the stationary stators 44*a*, 44*b*, the transfer stator 46 may also include a plurality of coils of wire 48 operably connected to the source of electricity (not shown). The transfer stator 46 may be moveable from a first position in the first hoistway portion 12 to a second position in the second hoistway portion 16. In operation, the interaction of the mover 42 and the stator (44*a*, 44*b*, or 46) generates a thrust that propels the car 14 (attached to the mover 42). For example, in one embodiment, the mover 42 (and the car 14 attached to the mover 42) is vertically propelled when the coils of wire 48 of the stator (44*a*, 44*b* or 46) adjacent to the mover 42 are energized.

Figure 4B:
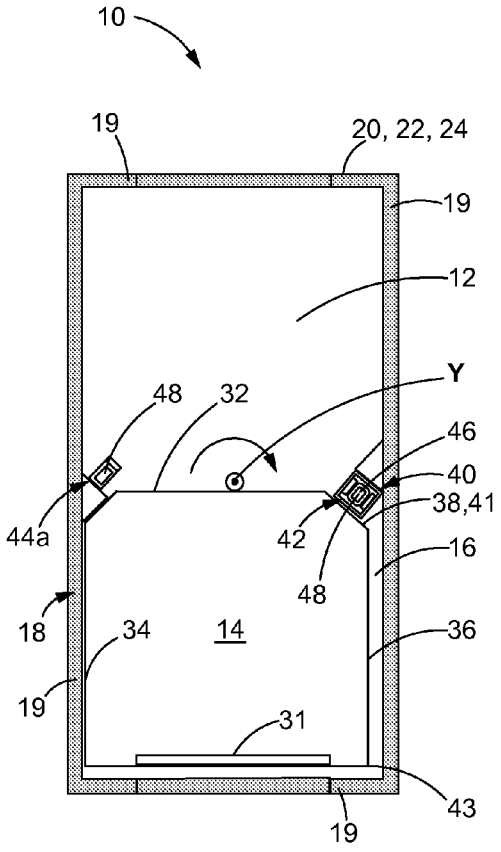
FIG. 4B is a top view of the elevator car of FIG. 4A after it has been rotated about the vertical axis Y into the second hoistway portion.

In FIG. 4A, the car 14 is disposed in the first hoistway portion 12. In this exemplary embodiment, the mover 42 is disposed on a vertical corner 38 at the intersection of the back side 32 and the right side 36 of the car 14. In FIG. 4B, the car 14 has moved to the second hoistway portion 16. The arrow in FIG. 4B illustrates the rotation of approximately 180° about the vertical axis Y of the car 14 from the first hoistway portion 12 to the second hoistway portion 16.

In the embodiment illustrated in FIG. 4A, the first stationary stator 44*a* (best seen in FIGS. 1-2) is mounted in the first hoistway portion 12 and the transfer stator 46 (FIG. 4A) is positioned in the first hoistway portion 12 at the transfer station. The car 14, the mover 42 and the transfer stator 46 rotate about the vertical axis Y from a first position in the first hoistway portion 12 to a second position in the second hoistway portion 16 (FIG. 4B). Initially after the rotation, the mover 42 is adjacent to the transfer stator 46. However, as the car 14 travels vertically in the second hoistway portion 16, the mover 42 will transition from the transfer stator 46 to the stationary stator 44*b* mounted in the second hoistway portion 16. When the car is in the first hoistway portion 12, the linear motor 40 includes the mover 42 and either the first stationary stator 44*a* or the transfer stator 46. When the car is in the second hoistway portion 16, the linear motor 40 includes the mover 42 and either the second stationary stator 44*b* or the transfer stator 46.

Figure 4C:
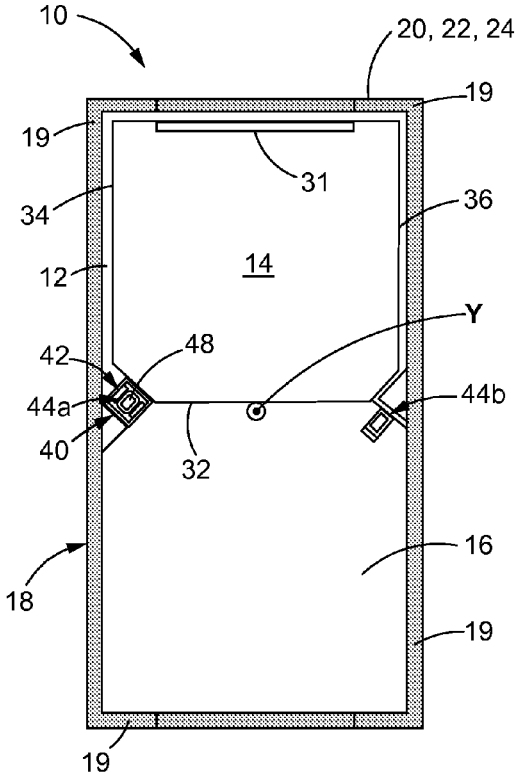
FIG. 4C is a top view of one embodiment of an elevator car in a first hoistway portion.
Figure 4D:
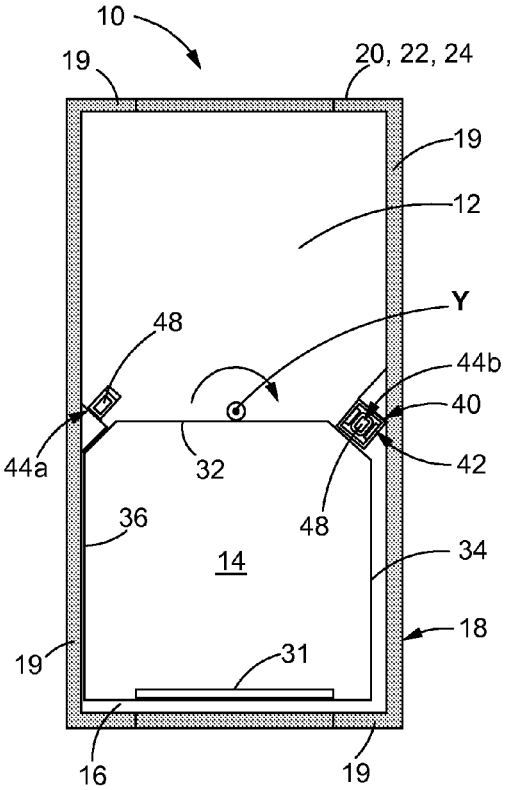
FIG. 4D is a top view of the elevator car of FIG. 4C after it has been rotated about the vertical axis Y into the second hoistway portion.

This can be contrasted with the embodiment illustrated in FIGS. 4C-D in which the elevator system 10 does not include the transfer stator 46. In such an embodiment, the mover 42 rotates about the vertical axis Y with the car 14 but the first stationary stator 44*a* does not. Thus, once the car 14 has moved from the first hoistway portion 12 to the second hoistway portion 16, the mover 42 is adjacent to a second stationary stator 44*b* other than the first stationary stator 44*a*.

In FIG. 4C, the waiting second stationary stator 44*b* at the transfer station can be seen in the second hoistway portion 16. In FIG. 4D, the first stationary stator 44*a* (at the transfer station), relieved of its operable connection to the mover 42, may be seen in the first hoistway portion 12.

Figure 5:
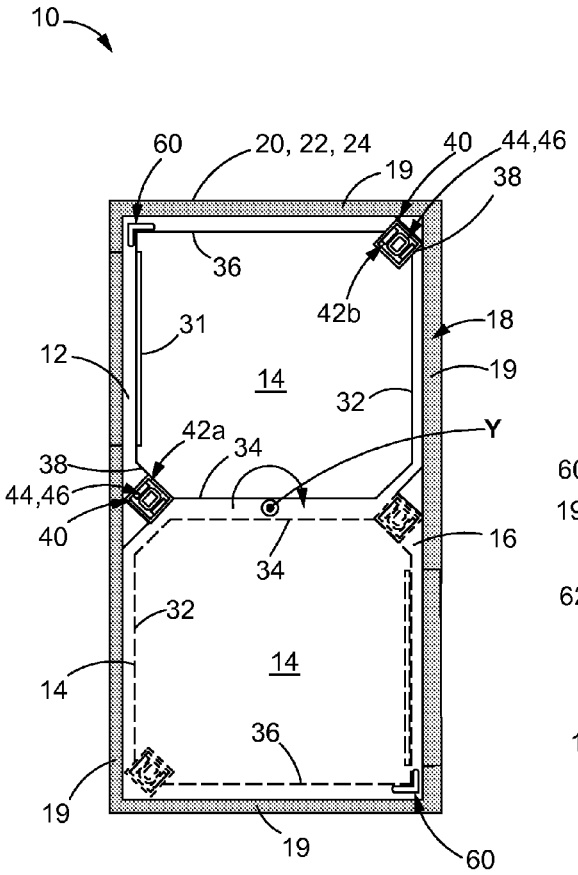
FIG. 5 is a top view of the elevator car in a first hoistway portion and after it has been rotated about the vertical axis Y into the second hoistway portion.

In the embodiment illustrated in FIGS. 4A-D, one linear motor 40 is illustrated. Other embodiments may include more than one linear motor per car 14. FIG. 5 illustrates a similar embodiment as that of FIGS. 4A-D but with two linear motors 40 per car 14. In addition, in some embodiments, the elevator system 10 may also include one or more car guidance systems 60 (see, for example, FIG. 6).

In FIG. 5 the car 14 is disposed in the first hoistway portion 12. In this embodiment, two linear 40 motors are disposed proximal to diagonally opposite corners 38 of the car 14. A first mover 42*a* is mounted on a first corner of the car and a second mover 42*b* is mounted on the car diagonally opposite to the first mover 42*a*. The arrow in FIG. 5 illustrates the rotation of approximately 180° about the vertical axis Y of the car 14 from the first hoistway portion 12 to the second hoistway portion 16. The position of the car 14 in the second hoistway portion 16 after rotation is shown in broken lines in FIG. 5.

Figure 6:
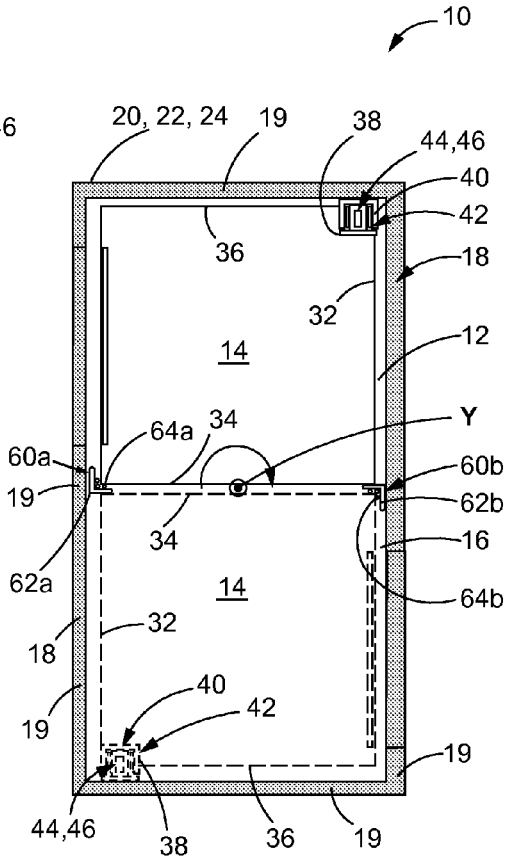
FIG. 6 is a top view of the elevator car in a first hoistway portion and after it has been rotated about the vertical axis Y into the second hoistway portion.

In some embodiments, the elevator system 10 may include one or more car guidance systems 60 disposed in each of the first and second hoistway portions 12, 16. FIG. 6 illustrates such an arrangement. In one exemplary embodiment, the car guidance system 60 may comprise a guiderail 62 and a guide portion 64 (for example, a roller assembly) as is known in the art. The guiderail 62 may be mounted on a hoistway sidewall 19 (in a hoistway portion 12, 16) and the guide portion 64, such as a roller assembly, may be mounted on a side 30, 32, 34, 36 or a vertical corner 38 of the car 14. The guiderail may include a plurality of guiderail components or may be integral.

In FIG. 6, the car 14 is initially disposed in the first hoistway portion 12. In this embodiment, a linear motor 40 is disposed adjacent to a corner 38 of the car 14. The arrow in FIG. 6 illustrates the rotation of approximately 180° about the vertical axis Y of the car 14 from the first hoistway portion 12 to the second hoistway portion 16. The position of the car 14 in the second hoistway portion 16 after rotation is shown in broken lines in FIG. 6.

The car guidance system 60 is disposed adjacent to a vertical corner 38 of the car 14 and directly opposite to the mover 42 (and linear motor 40) on the other side of the car 14. In the embodiment illustrated in FIG. 6, a first car guidance system 60*a* is disposed in the first hoistway portion 12 proximal to a sidewall 19 of the hoistway 18 and on the opposite side of the car 14 than the mover 42 (and linear motor 40). A second car guidance system 60*b* may be disposed in the second hoistway portion 16 proximal to a sidewall 19 of the hoistway 18 and on the opposite side of the car 14 than the mover 42 (and linear motor 40) when the car 14 is positioned in the second hoistway portion 16. In the exemplary embodiment of FIG. 6, each car guidance system 60*a*, 60*b* comprises a rail and roller assembly system as is known in the art. As such, each car guidance system 60*a*, 60*b* may include a guiderail 62 and a guide portion 64. The guiderail 62 may be mounted on a hoistway 18 sidewall 19 or other appropriate structure and the guide portion 64 may be mounted on a vertical corner 38 or side of the car 14.

Figure 7:
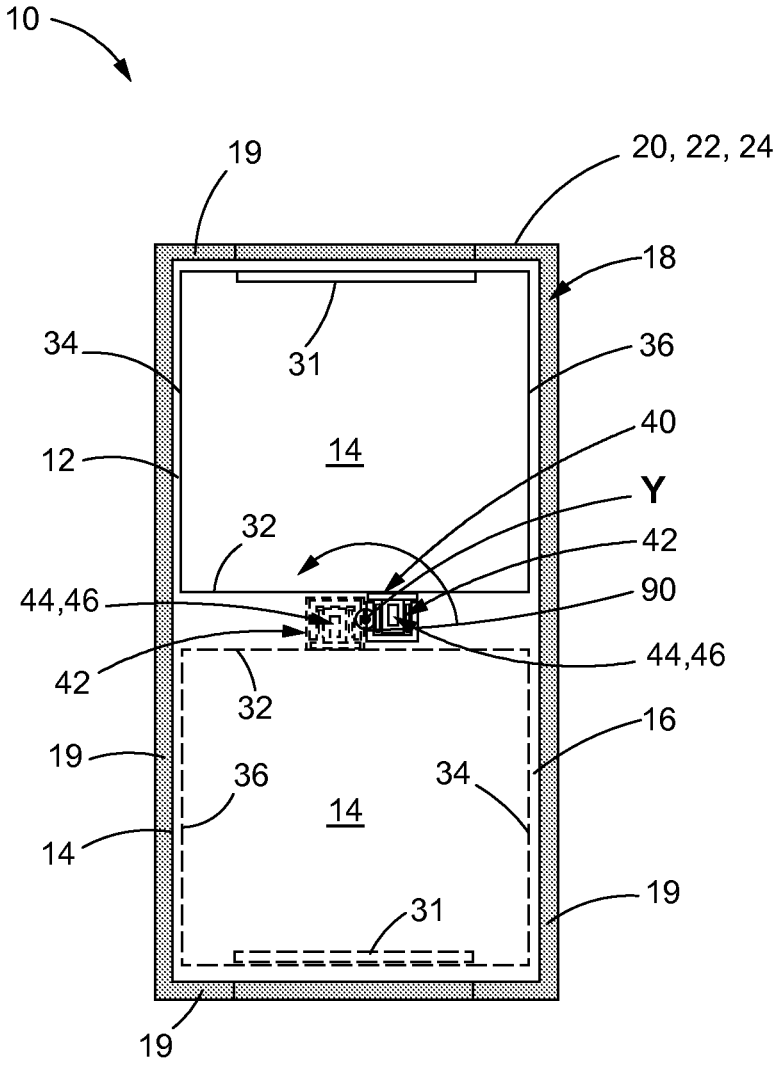
FIG. 7 is a top view of the elevator car in a first hoistway portion and after it has been rotated about the vertical axis Y into the second hoistway portion.

FIG. 7 illustrates yet another embodiment. In FIG. 7 the car 14 is initially disposed in the first hoistway portion 12. In this embodiment, a mover 42 (and linear motor 40) is disposed on a side of the car 14. The arrow in FIG. 7 illustrates the rotation of approximately 180° about the vertical axis Y of the car 14 from the first hoistway portion 12 to the second hoistway portion 16. The position of the car 14 in the second hoistway portion 16 after rotation is shown in broken lines in FIG. 7. In some embodiments, a transfer stator 46 may be mounted to a rod 90 or the like disposed along the vertical axis Y. When the rod rotates about the vertical axis Y, the transfer stator 46 rotates with the rod 90. In some embodiments, the elevator system 10 may include one or more guidance systems 60 disposed in each of the first and second hoistway portions 12, 16.

FIGS. 8-11 illustrate the rotation of the car 14 about an axis X from the first hoistway portion 12 to the second hoistway portion 16 in the transfer station. The axis X is parallel to the floor 21 (see FIGS. 1-2) of the hoistway 18 (the "horizontal axis") and is also an axis of symmetry with a degree of rotational symmetry of 180°.

Figure 8A:
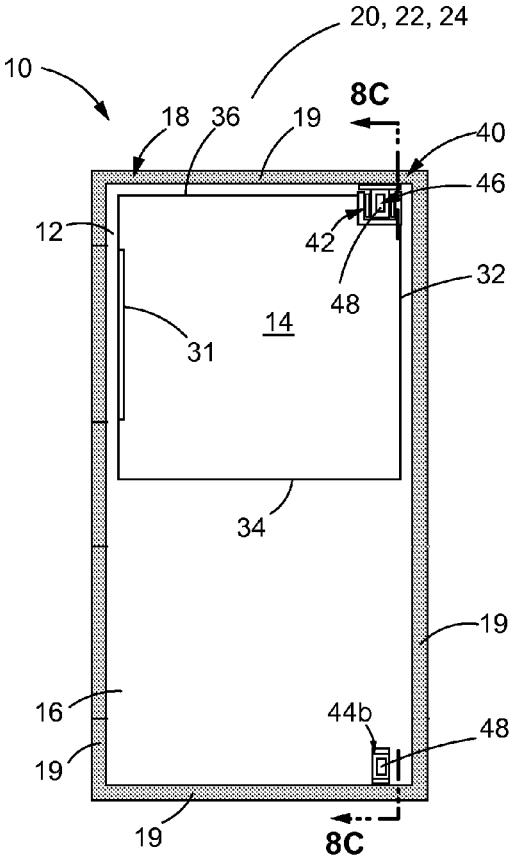
FIG. 8A is a top view of one embodiment of an elevator car in a first hoistway portion.
Figure 8B:
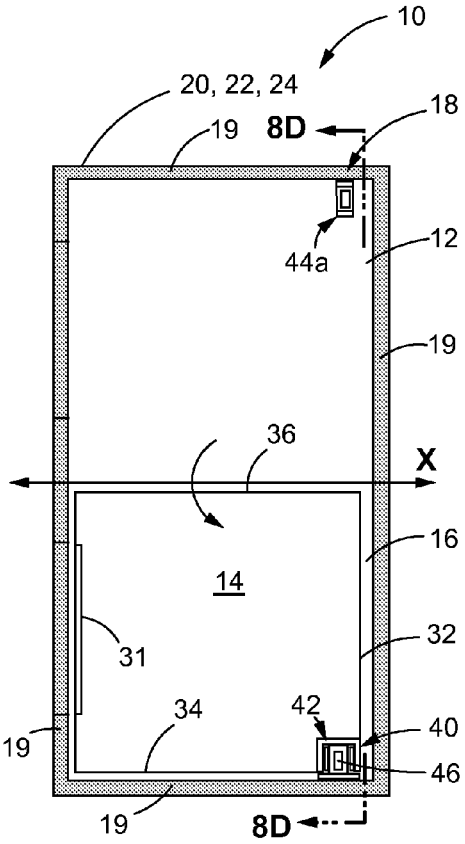
FIG. 8B is a top view of the elevator car of FIG. 8A after it has been rotated about the horizontal axis X into the second hoistway portion.
Figure 8C:
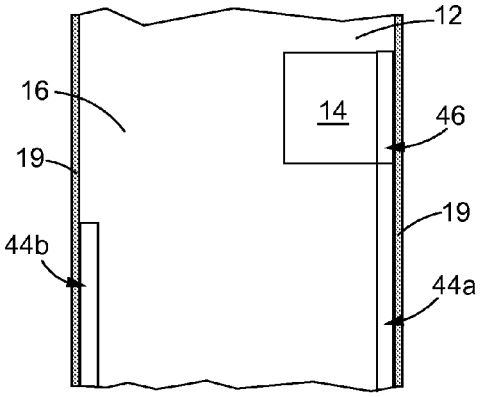
FIG. 8C is a schematic side view of the hoistway and elevator car of FIG. 8A taken along the lines 8C-8C.
Figure 8D:
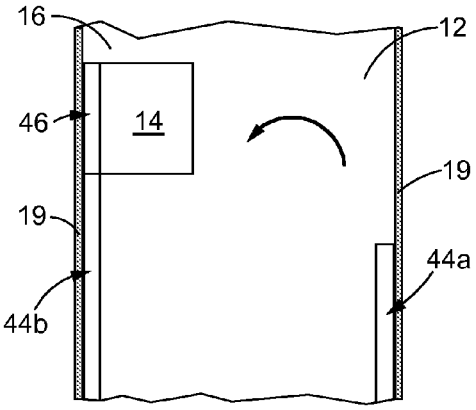
FIG. 8D is a schematic side view of the hoistway and elevator car of FIG. 8B taken along the lines 8D-8D.

In FIG. 8A, therein is illustrated an embodiment of the elevator system 10 that includes the hoistway 18, the car 14, a mover 42 and stationary stators 44*a*, 44*b* (FIGS. 8C-8D). The hoistway 18 includes a first hoistway portion 12 and a second hoistway portion 16. The mover 42 is mounted on the car 14. The stationary stators 44*a*, 44*b* may be mounted on a support column (not pictured) or sidewall 19 of the hoistway 18. The elevator system 10 may further include the transfer stator 46. Similar to the stationary stators 44*a*, 44*b*, the transfer stator 46 may also include a plurality of coils of wire 48 operably connected to the source of electricity (not shown). The transfer stator 46 may be moveable from a first position in the first hoistway portion 12 to a second position in the second hoistway portion 16.

In operation, the mover 42 (and the car 14 attached to the mover 42) is vertically propelled when the coils of wire 48 of the stator (44*a*, 44*b* or 46) adjacent to the mover 42 are energized.

In FIG. 8A the car 14 is disposed in the first hoistway portion 12. In this exemplary embodiment, the mover 42 (and linear motor 40) is disposed adjacent to a vertical corner at the intersection of the back side 32 and the right side 36. In FIG. 8B, the car 14 has moved to the second hoistway portion 16. The arrow in FIG. 8B illustrates the rotation of approximately 180° about the horizontal axis X of the car 14 from the first hoistway portion 12 to the second hoistway portion 16. Both the transfer stator 46 and the mover 42 rotate with the car 14 about the vertical axis Y from the first hoistway portion 12 into the second hoistway portion 16.

In the embodiment illustrated in FIGS. 8A and 8C, the first stationary stator 44*a* is mounted in the first hoistway portion 12 and the transfer stator 46 is positioned adjacent to the first stationary stator 44*a* in the first hoistway portion 12 at the transfer station. The car 14, the mover 42 and the transfer stator 46 rotate about the horizontal axis X from a first position in the first hoistway portion 12 to a second position in the second hoistway portion 16 (FIGS. 8B and 8D). Initially after the rotation, the mover 42 is adjacent to the transfer stator 46 (FIG. 8D). However, as the car 14 travels vertically in the second hoistway portion 16, the mover 42 will transition from the transfer stator 46 to the stationary stator 44*b* mounted in the second hoistway portion 16.

Figure 8E:
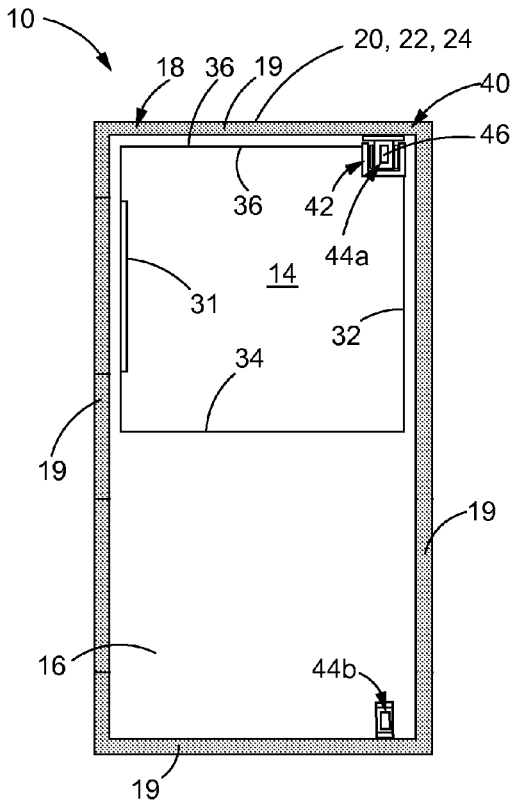
FIG. 8E is a top view of one embodiment of an elevator car in a first hoistway portion.
Figure 8F:
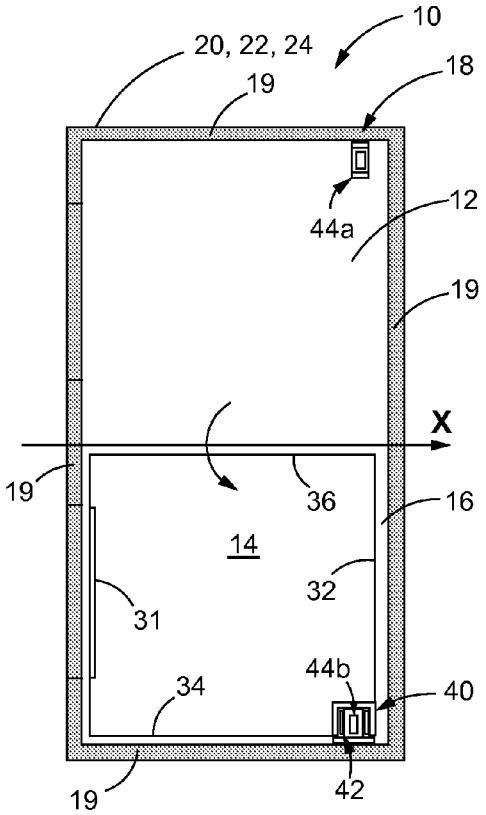
FIG. 8F is a top view of the elevator car of FIG. 8C after it has been rotated about the horizontal axis X into the second hoistway portion.

This scenario can be contrasted with the embodiment illustrated in FIGS. 8E-F in which the elevator system 10 does not include the transfer stator 46. In such an embodiment, the mover 42 rotates about the horizontal axis X with the car 14 but the first stationary stator 44*a* does not. Thus, once the car 14 has moved from the first hoistway portion 12 to the second hoistway portion 16, the mover 42 is adjacent to a second stationary stator 44*b* other than the first stator 44*a*. In FIG. 8E, the waiting second stationary stator 44*b* at the transfer station can be seen in the second hoistway portion 16. In FIG. 8F, the first stationary stator 44*a* (at the transfer station), relieved of its operable connection to the mover 42, may be seen in the first hoistway portion 12.

Figure 9:
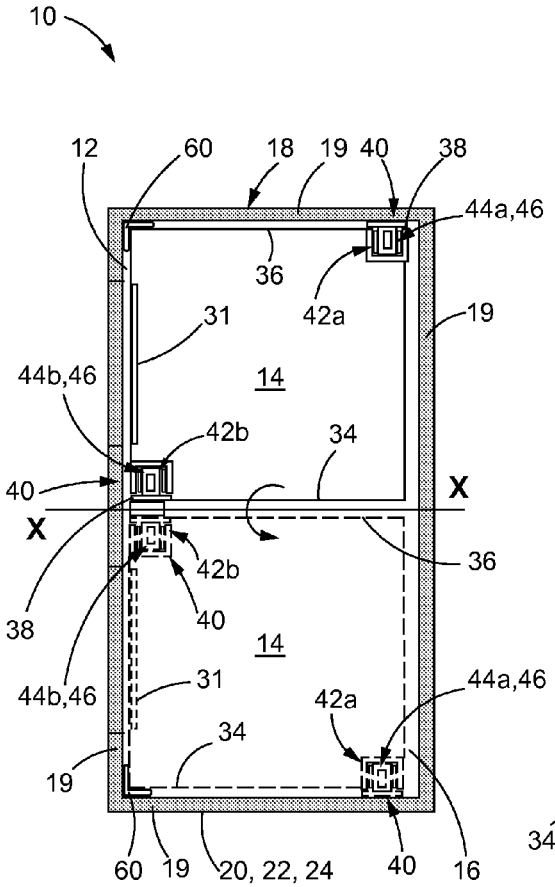
FIG. 9 is a top view of the elevator car in a first hoistway portion and after it has been rotated about the horizontal axis X into the second hoistway portion.

In the embodiment illustrated in FIGS. 8A-F, one linear motor 40 is illustrated. Other embodiments may include more than one linear motor per car 14. FIG. 9 illustrates a similar embodiment as FIGS. 8A-F but with two linear motors 40. In some embodiments, the elevator system 10 may include one or more car guidance systems 60.

In FIG. 9 the car 14 is initially disposed in the first hoistway portion 12. In this embodiment, two linear 40 motors are disposed proximal to diagonally opposite vertical corners 38 of the car 14. A first mover 42*a* is mounted adjacent to a first vertical corner of the car and a second mover 42*b* is mounted on the car diagonally opposite to the first mover 42*a*. The arrow in FIG. 9 illustrates the rotation of approximately 180° about the horizontal axis X of the car 14 from the first hoistway portion 12 to the second hoistway portion 16. The position of the car 14 in the second hoistway portion 16 after rotation is shown in broken lines in FIG. 9. In some embodiments, as noted previously, the elevator system 10 may include one or more car guidance systems disposed in each of the first and second hoistway portions 12, 16.

Figure 10:
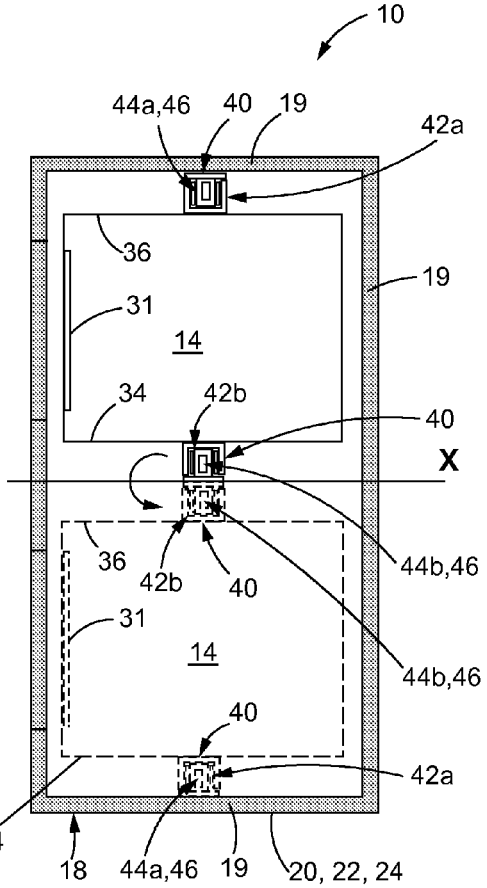
FIG. 10 is a top view of the elevator car in a first hoistway portion and after it has been rotated about the horizontal axis X into the second hoistway portion.

FIG. 10 illustrates yet another embodiment. In FIG. 10 the car 14 is initially disposed in the first hoistway portion 12. In this embodiment, a pair of linear motors 40 is centered on opposing sides of the car 14. The arrow in FIG. 10 illustrates the rotation of approximately 180° about the horizontal axis X of the car 14 from the first hoistway portion 12 to the second hoistway portion 16. The position of the car 14 in the second hoistway portion 16 after rotation is shown in broken lines in FIG. 10.

Figure 11:
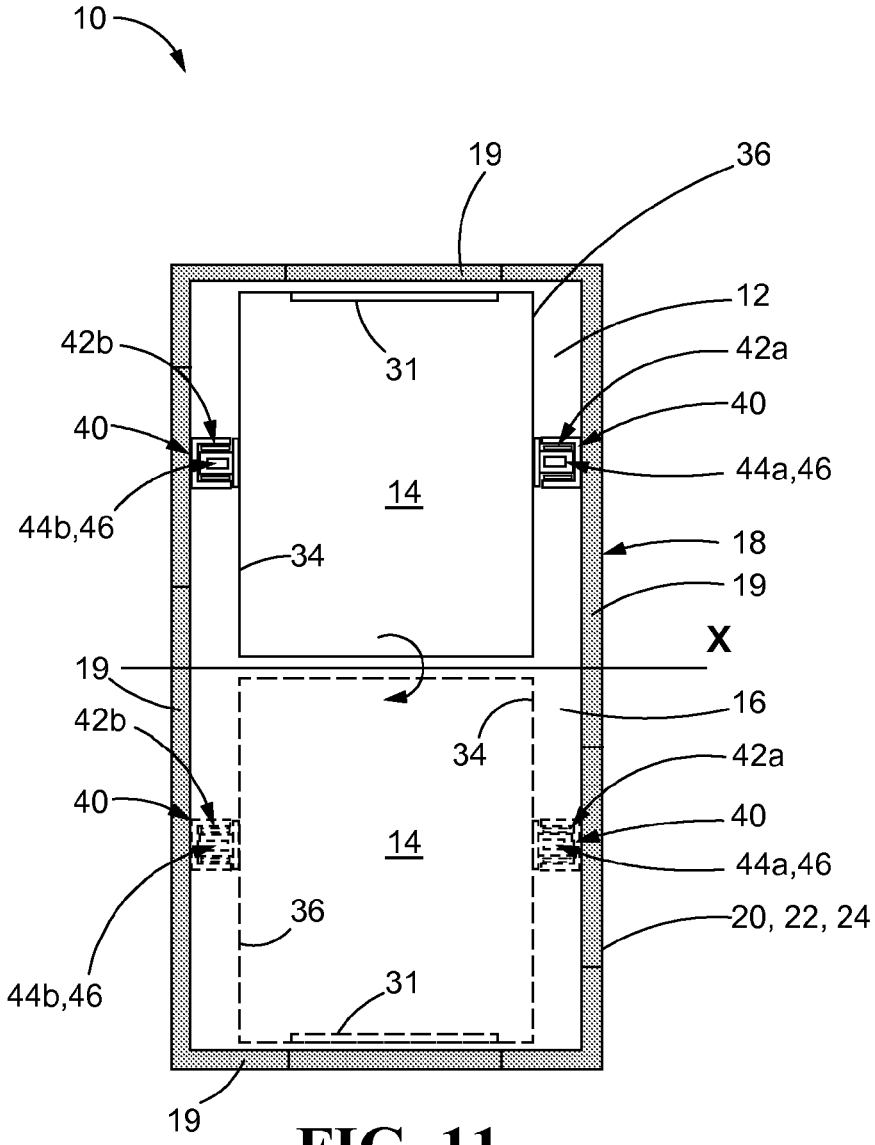
FIG. 11 is a top view of the elevator car in a first hoistway portion and after it has been rotated about the horizontal axis X into the second hoistway portion.

FIG. 11 illustrates yet another embodiment. In FIG. 11 the car 14 is initially disposed in the first hoistway portion 12. In this embodiment, a pair of linear motors 40 is disposed on opposing sides of the car 14. The arrow in FIG. 11 illustrates the rotation of approximately 180° about the horizontal axis X of the car 14 from the first hoistway portion 12 to the second hoistway portion 16. The position of the car 14 in the second hoistway portion 16 after rotation is shown in broken lines in FIG. 11.

The above are exemplary embodiments and are intended to illustrate the principles of the disclosure. In each of the above embodiments describing horizontal shifting, rotation about the vertical axis or rotation about the horizontal axis, one or more linear motors 40 may be used to propel the car 14. Such linear motor(s) 40 may be disposed on any side 30, 32, 34, or 36 or vertical corner 38 of the car 14. In addition, in some embodiments, the elevator system 10 may include one or more car guidance systems 60. Included within the spirit of the disclosure are embodiments in which a single linear motor 40 may used to propel a car with no guiderail 62. Alternatively, a single linear motor 40 may used in conjunction with one or more car guiderails 62. In other embodiments, two or more linear motors 40 may be used to propel a car with no associated guiderail 62. Alternatively, two or more linear motors may be used to propel a car with one or more guiderails 62. In embodiments with two or more linear motors 40, the motors may, in some embodiments, be disposed symmetrically on the car 14. For example such linear motors may be disposed, on diagonally opposing corners, or centered on opposite sides of the car 14. In other embodiments, the linear motors 40 may not be symmetrically disposed on the car 14.

Figure 12:
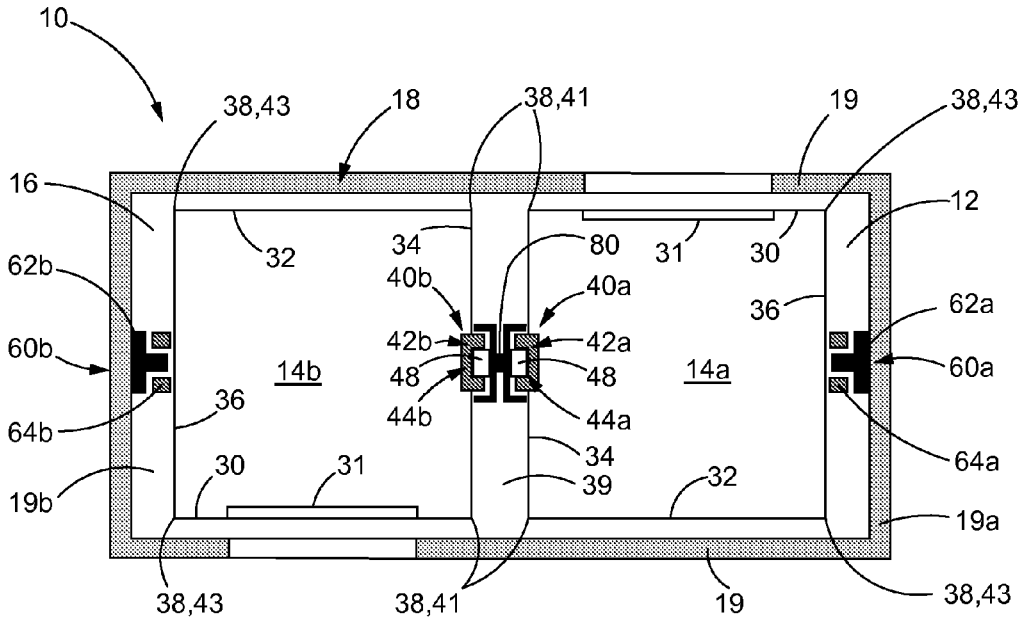
FIG. 12 is a top view of a first car in the first hoistway portion and a second car in the second hoistway portion.

In some embodiments, a first stator 44*a* of a linear motor 40 utilized for a first car 14*a* disposed in the first hoistway portion 12 (the "first hoistway linear motor" 40*a*), and a second stator 44*b* of a linear motor 40 utilized for a second car 14*b* in the second hoistway portion 16 (the "second hoistway linear motor" 40*b*) may be disposed on a common support column 80 vertically situated between the first and second hoistway portions 12, 16 in the transition region 39. FIG. 12 illustrates such an embodiment.

More specifically, as illustrated in FIG. 12, the first hoistway linear motor 40*a* may comprise a first mover 42*a* mounted on the first car 14*a* and a first stationary stator 44*a*, adjacent to the first mover 42*a*, and mounted on the support column 80. The second hoistway linear motor 40*b* may comprise a second mover 42*b* mounted on the second car 14*b* and a second stationary stator 44*b*, adjacent to the second mover 42*b*, and mounted on the support column 80. In the embodiment illustrated in FIG. 12, only one linear motor 40 is utilized to vertically propel a car. In the exemplary embodiment illustrated in FIG. 12, the linear motor 40 is horizontally centered on each car. In other embodiments, the linear motor 40 may be disposed elsewhere (for example, not centered or offset from the center of the car.) In addition, in some embodiments, but not all, the position of each car 14 within each respective hoistway portion 12, 16 may be horizontally centered on the support column 80. Using one linear motor 40 per car 14 reduces the weight that each car 14 must carry and the amount of coils 48 on the support column 80. By utilizing a common support column 80 for both linear motors 40*a*, 40*b*, the power cable distribution cables to the coils 48 is simplified.

In the embodiment of FIG. 12, the elevator system 10 may include a single car guidance system 60 adjacent to a side of the car 14 and disposed directly opposite to the linear motor 40 on the other side of the car in order to increase the uniformity of force distribution action on the car 14. In the embodiment illustrated in FIG. 12, a first car guidance system 60*a* is disposed in the first hoistway portion 12 proximal to a sidewall 19 of the hoistway 18 and on the opposite side of the car 14*a* than the first hoistway linear motor 40*a*. A second car guidance system 60*b* may be disposed in the second hoistway portion 16 proximal to a sidewall 19 of the hoistway 18 and on the opposite side of the second car 14*b* than the second hoistway linear motor 40*b*. In one embodiment, each car guidance system 60*a*, 60*b* may comprise a guiderail 62 mounted on a hoistway sidewall 19 and a guide portion 64 mounted on a side of the car 14. For example, in the embodiment shown in FIG. 12, a first rail 62*a* is disposed in the first hoistway portion 12 proximal to a first sidewall 19*a* of the hoistway 18 and the second rail 62*b* is disposed in the second hoistway portion 16 proximal to a second sidewall 19*b* of the hoistway 18. In some embodiments, the car guidance system 60 may be horizontally centered on the side of the car 14 so that it is directly opposite the associated linear motor 40. The use of a single car guidance system 60 per car 14 reduces cost. The single car guidance system 60 is so positioned to provide an additional support point for the car and eliminate the use of active compensation devices, for example EM guidance units, together with a closed loop control system on each car. Use and positioning of the guiderail of the car guidance system spreads the load of the car and its occupants between the support column and the guiderail and allows for use of a simplified safety brake such as traditional safety brakes, elevator brake sub-systems or electronic safety actuators.

Figure 13:
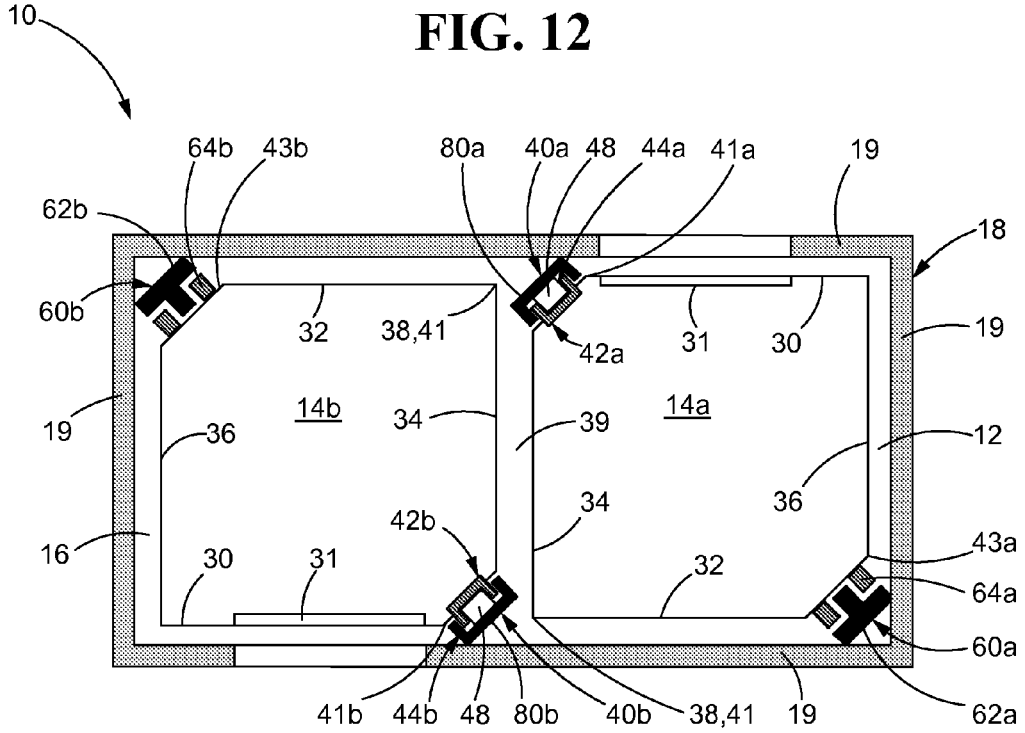
FIG. 13 is another top view of a first car in the first hoistway portion and a second car in the second hoistway portion.

FIG. 13 illustrates another embodiment, in which a first linear motor 40*a* may be disposed adjacent to an inner vertical corner 41 of a first car 14*a* in the first hoistway portion 12, and the second linear motor 40*b* may be disposed adjacent to a second inner corner 41 of a second car 14*b* in the second hoistway portion 16. The first and second inner corners being opposite corners. This embodiment enables a reduction of the hoistway 18 footprint by reducing the amount of space required between the hoistway portions.

In FIG. 13, the elevator system 10 includes a first and second support columns 80*a*, 80*b* generally vertically disposed within the hoistway 18. The support guidance system 60 and linear motor 40 for each car 14 are adjacent to diagonally opposite corners of the elevator car 14. For example, the first hoistway linear motor 40*a* is disposed on an inner vertical corner 41*a* of the first car 14*a* at the intersection of the front and left sides 30, 34 of the car 14*a*, and the car guidance system 60*a* is disposed proximal to the diagonally opposite outer vertical corner 43*a* of the car 14*a*. The second hoistway linear motor 40*b* is disposed on an inner vertical corner 41*b* of the car 14*b* at the intersection of the front and left sides 30, 34 of the second car 14*b*, and the car guidance system 60*b* is disposed proximal to the diagonally opposite outer vertical corner 43*b* of the second car 14*b*.

INDUSTRIAL APPLICABILITY

In light of the foregoing, it can be seen that the present disclosure sets forth a ropeless elevator system utilizing a linear motor. Such ropeless elevators may be most appropriate to avoid cabling restraints that may occur in relatively tall elevator hoistways. In such operations, a car may generally move vertically in a first direction in a first hoistway portion and the same car may move vertically in a second direction in a second hoistway portion. The car may be operably movable from one hoistway portion to the other at a transfer station. As disclosed herein, the movement may be horizontal shifting, rotation about a vertical axis or rotation about a horizontal axis.

In some embodiments, a single linear motor may be used to propel a car in a hoistway portion. Using one linear motor per car reduces the weight that each car must carry and the amount of coils on the support column. By utilizing a common support column for both linear motors, the power cable distribution cables to the coils is simplified.

Positioning a first linear motor adjacent to an inner vertical corner of a first car in the first hoistway portion, and the second linear motor adjacent to a second inner corner of a second car in the second hoistway portion enables a reduction of the elevator hoistway footprint by reducing the amount of space required between the hoistway portions. The footprint is further reduced by using a single car guidance system per car and disposing it on the opposite vertical corner of the car than the linear motor.

In addition the use of a single car guidance system per car reduces cost. The single car guidance system is so positioned to provide an additional support point for the car and eliminate the use of active compensation devices, for example EM guidance units, together with a closed loop control system on each car. Use and positioning of the guiderail of the car guidance system spreads the load of the car and its occupants between the support column and the guiderail and allows for use of a simplified safety brake such as traditional safety brakes, elevator brake sub-systems or electronic safety actuators.

While only certain embodiments have been set forth, alternatives and modifications will be apparent from the above description to those skilled in the art. These and other alternatives are considered equivalents and within the spirit and scope of this disclosure.

What is claimed is:

1. An elevator system comprising:

a hoistway including a first hoistway portion and a second hoistway portion;

a first car disposed within the first hoistway portion;

a first stationary stator disposed in the first hoistway portion;

a second stationary stator disposed in the second hoistway portion;

a first mover mounted on the first car, the first car propelled in the first hoistway portion by only the interaction of the first mover with the first stationary stator the first car propelled in the second hoistway portion by only the interaction of the first mover with the second stationary stator; and a first guiderail disposed in the first hoistway portion, wherein the first hoistway portion is free of other guiderails;

the first car has a first side and a second side, the second side opposite to the first side, wherein the first mover is mounted to the first side and a first guide portion is mounted to the second side of the first car, the first guide portion configured to interact with the first guiderail when the first car is disposed in the first hoistway portion.

2. The elevator system of claim 1, in which the first car includes a first car inner vertical corner, wherein the first mover is mounted on the first car inner vertical corner.

3. The elevator system of claim 1, further including:

a second car disposed within the second hoistway portion; and a second mover mounted on the second car, the second car propelled in the second hoistway portion by only the interaction of the second mover with the second stationary stator, the second car propelled in the first hoistway portion by only the interaction of the second mover with the first stationary stator.

4. The elevator system of claim 3, in which the second car includes a second car inner vertical corner, wherein the second mover is mounted on the second car inner vertical corner.

5. The elevator system of claim 4, further including a second guiderail disposed in the second hoistway portion, wherein the second hoistway portion is free of other guiderails.

6. An elevator system comprising:

a hoistway including a first hoistway portion and a second hoistway portion;

a first car disposed within the first hoistway portion;

a first stationary stator disposed in the first hoistway portion;

a second stationary stator disposed in the second hoistway portion;

a first mover mounted on the first car, the first car propelled in the first hoistway portion by only the interaction of the first mover with the first stationary stator, the first car propelled in the second hoistway portion by only the interaction of the first mover with the second stationary stator; and a first guiderail disposed in the first hoistway portion, wherein the first hoistway portion is free of other guiderails;

the first car includes a first car inner vertical corner, wherein the first mover is mounted on the first car inner vertical corner;

wherein the first guiderail is disposed diagonally opposite to the first mover when the first car is disposed in the first hoistway portion.

7. An elevator system comprising:

a hoistway including a first hoistway portion and a second hoistway portion;

a first guiderail disposed in the first hoistway portion, the first hoistway portion free of other guiderails;

a second guiderail disposed in the second hoistway portion, the second hoistway portion free of other guiderails;

a first stationary stator disposed in the first hoistway portion opposite to the first guiderail;

a second stationary stator disposed in the second hoistway portion opposite to the second guiderail; and a plurality of elevator cars, each car having a mover mounted to the car and a guide portion mounted to the car, the guide portion disposed on an opposite side of the elevator car as the mover, wherein the mover interacts with only the first stationary stator and the guide portion interacts with only the first guiderail, when the car is in the first hoistway portion, and wherein the mover interacts only with the second stationary stator and the guide portion interacts with only the second guiderail, when the car is in the second hoistway portion.

8. The elevator system of claim 7, in which each car includes an inner vertical corner, wherein the mover is mounted on the inner vertical corner of the car.

9. An elevator system comprising:

a hoistway including a first hoistway portion and a second hoistway portion;

a first guiderail disposed in the first hoistway portion, the first hoistway portion free of other guiderails;

a second guiderail disposed in the second hoistway portion, the second hoistway portion free of other guiderails;

a first stationary stator disposed in the first hoistway portion opposite to the first guiderail;

a second stationary stator disposed in the second hoistway portion opposite to the second guiderail; and a plurality of elevator cars, each car having a mover mounted to the car and a guide portion mounted to the car, the guide portion disposed opposite to the mover, wherein the mover interacts with only the first stationary stator and the guide portion interacts with only the first guiderail, when the car is in the first hoistway portion, and wherein the mover interacts only with the second stationary stator and the guide portion interacts with only the second guiderail, when the car is in the second hoistway portion;

each car includes an inner vertical corner, wherein the mover is mounted on the inner vertical corner of the car;

wherein the first guiderail is diagonally opposite to the mover when the car is in the first hoistway portion, and the second guiderail is diagonally opposite to the mover when the car is in the second hoistway portion.

10. An elevator system comprising:

a hoistway including a first hoistway portion and a second hoistway portion;

a first guiderail disposed in the first hoistway portion, the first hoistway portion free of other guiderails;

a second guiderail disposed in the second hoistway portion the second hoistway portion free of other guiderails;

a first stationary stator disposed in the first hoistway portion opposite to the first guiderail;

a second stationary stator disposed in the second hoistway portion opposite to the second guiderail; and a plurality of elevator cars, each car having a mover mounted to the car and a guide portion mounted to the car, the guide portion disposed opposite to the mover, wherein the mover interacts with only the first stationary stator and the guide portion interacts with only the first guiderail, when the car is in the first hoistway portion, and wherein the mover interacts only with the second stationary stator and the guide portion interacts with only the second guiderail, when the car is in the second hoistway portion;

a support column generally vertically disposed between the first and second hoistway portions (12, 16), wherein the first and second stationary stators (44*a*, 44*b*) are mounted on the support column.

11. An elevator system comprising:

a hoistway including a first hoistway portion and a second hoistway portion;

a car disposed within the first hoistway portion, the car operably moveable from the first hoistway portion to the second hoistway portion, the car having a plurality of sides (30, 32, 34, 36), wherein all of the sides (30, 32, 34, 36) of the car are non-curvilinear;

a first mover mounted on the car;

a first stationary stator disposed in the first hoistway portion;

a second stationary stator disposed in the second hoistway portion, wherein the first mover interacts with the first stationary stator to propel the car when the car is in the first hoistway portion, and wherein the first mover interacts with the second stationary stator to propel the car when the car is in the second hoistway portion;

wherein the car is rotatable about an axis of rotation (X, Y) from the first hoistway portion to the second hoistway portion;

wherein the axis of rotation is a vertical axis Y.

12. The elevator system of claim 11, wherein the first stationary stator remains in the first hoistway portion when the car has been operably moved to the second hoistway portion.

13. The elevator system of claim 11, further including:

a first guiderail disposed generally vertically in the first hoistway portion; and a first guide portion mounted on the car, wherein the first guide portion interacts with the first guiderail when the car is disposed in the first hoistway portion.

14. The elevator system of claim 11, further including a transfer stator disposed in the hoistway, wherein the transfer stator is rotatable with the car about an axis of rotation from the first hoistway portion to the second hoistway portion.

15. The elevator system of claim 11 further including:

a second mover mounted on the car;

a third stationary stator disposed in the first hoistway portion; and a fourth stationary stator disposed in the second hoistway portion, wherein the second mover interacts with the third stationary stator to propel the car when the car is in the first hoistway portion, and wherein the second mover interacts with the fourth stationary stator to propel the car when the car is in the second hoistway portion.

16. An elevator system comprising:

a hoistway including a first hoistway portion and a second hoistway portion;

a car disposed within the first hoistway portion, the car operably moveable from the first hoistway portion to the second hoistway portion the car having a plurality of sides, wherein all of the sides of the car are non-curvilinear;

a first mover mounted on the car;

a first stationary stator disposed in the first hoistway portion;

a second stationary stator disposed in the second hoistway portion, wherein the first mover interacts with the first stationary stator to propel the car when the car is in the first hoistway portion, and wherein the first mover interacts with the second stationary stator to propel the car when the car is in the second hoistway portion;

a transfer stator disposed in the hoistway wherein the transfer stator is rotatable with the car about an axis of rotation from the first hoistway portion to the second hoistway portion;

wherein the axis of rotation X is an axis of symmetry with respect to the first mover position relative to the car.

* * * * *